US008702876B2

(12) United States Patent
Yao et al.

(10) Patent No.: US 8,702,876 B2
(45) Date of Patent: Apr. 22, 2014

(54) STEEL PLATE HAVING A LOW WELDING CRACK SUSCEPTIBILITY AND A YIELD STRENGTH OF 800MPA AND MANUFACTURE METHOD THEREOF

(75) Inventors: Liandeng Yao, Shanghai (CN); Xiaoting Zhao, Shanghai (CN); Sixin Zhao, Shanghai (CN)

(73) Assignee: Boashan Iron & Steel Co., Ltd., Shanghai (CN)

( * ) Notice: Subject to any disclaimer, the term of this patent is extended or adjusted under 35 U.S.C. 154(b) by 361 days.

(21) Appl. No.: 12/524,311

(22) PCT Filed: Oct. 24, 2008

(86) PCT No.: PCT/CN2008/072807

§ 371 (c)(1),
(2), (4) Date: Jul. 23, 2009

(87) PCT Pub. No.: WO2009/056055

PCT Pub. Date: May 7, 2009

(65) Prior Publication Data

US 2010/0032062 A1 Feb. 11, 2010

(30) Foreign Application Priority Data

Oct. 26, 2007 (CN) ..... 2007 1 0094177

(51) Int. Cl.
*C22C 38/00* (2006.01)

(52) U.S. Cl.
USPC ..... 148/337; 148/330

(58) Field of Classification Search
None
See application file for complete search history.

(56) References Cited

U.S. PATENT DOCUMENTS 4,219,371 A 8/1980 Nakasugi et al.
4,521,258 A 6/1985 Tamehiro et al.

(Continued)

FOREIGN PATENT DOCUMENTS

CN 1249006 A 3/2000
CN 1840724 A 10/2006

(Continued)

OTHER PUBLICATIONS

English translation of Hayashi et al (JP 2003-147477).*

(Continued)

*Primary Examiner* — Yoshitoshi Takeuchi
(74) *Attorney, Agent, or Firm* — Hamre, Schumann, Mueller & Larson, P.C.

(57) ABSTRACT

The present invention provides a steel plate having a low welding crack susceptibility and a yield strength of 800 MPa and a manufacturing method for the same. The steel plate having a low welding crack susceptibility comprises the following chemical components (wt. %: percent by weight): C: 0.03-0.08 wt. %, Si: 0.05-0.70 wt. %, Mn: 1.30-2.20 wt. %, Mo: 0.10-0.30 wt. %, Nb: 0.03-0.10 wt. %, V: 0.03-0.45 wt. %, Ti: 0.002-0.040 wt. %, Al: 0.02-0.04 wt. %, B: 0.0010-0.0020 wt. %, the balance being Fe and unavoidable impurities, and the welding crack susceptibility index meets the following formula: Pcm≤0.20%. The thermo-mechanical controlled rolling and cooling processes is used to obtain an ultrafine bainite batten matrix structure, which increases the intensity, plasticity and toughness of the steel plate. The steel plate with a low welding crack susceptibility of the present invention has a yield strength of greater than 800 MPa, a tensile strength of greater than 900 MPa, a Charpy impact energy Akv (−20° C.) of no less than 150 J and an excellent welding performance.

1 Claim, 1 Drawing Sheet

(56) References Cited

U.S. PATENT DOCUMENTS

| | | | |
|---|---|---|---|
| 6,248,191 | B1 | 6/2001 | Luton et al. |
| 2004/0118489 | A1 | 6/2004 | Sun et al. |
| 2007/0193666 | A1 | 8/2007 | Asahi et al. |

FOREIGN PATENT DOCUMENTS

| | | | | | |
|---|---|---|---|---|---|
| CN | 1888120 | A | | 1/2007 | |
| DE | 2913584 | | | 10/1979 | |
| DE | 69821954 | | | 12/2004 | |
| JP | 56-96054 | | | 8/1981 | |
| JP | 57-19321 | A | | 2/1983 | |
| JP | 61-147812 | A | | 7/1986 | |
| JP | 62-10240 | A | | 1/1987 | |
| JP | 62-103347 | | | 5/1987 | |
| JP | 2001-152248 | | | 6/2001 | |
| JP | 2003-147477 | | * | 5/2003 | ..... C22C 38/00 |
| JP | 2005-281807 | | * | 3/2004 | ..... C22C 38/00 |
| JP | 2005-281807 | A | | 10/2005 | |

OTHER PUBLICATIONS

International Search Report of PCT/CN2008/072807, dated Feb. 5, 2009.

Liu et al. "Microalloying Steels with 800 MPa Yield Strength." Journal of University of Science and Technology Beijing, vol. 23, No. 4, 2001, pp. 357-361.

* cited by examiner

STEEL PLATE HAVING A LOW WELDING CRACK SUSCEPTIBILITY AND A YIELD STRENGTH OF 800MPA AND MANUFACTURE METHOD THEREOF

TECHNICAL FIELD

The present invention relates to a high strength structural steel, in particular, to a superfine bainite ferrite plate having a low welding crack susceptibility and a yield strength of 800 MPa.

BACKGROUND OF THE INVENTION

Cold welding crack is a very common defect in welding process. Particularly, when the high strength steel of low or middle alloy is welded, as the strength level increases, the propensity to form cold crack becomes greater. In order to prevent the generation of cold crack, preheating before welding and heat treatment after welding is usually required, thus, the greater the strength is, the higher the preheating temperature is, which leads to the complexity of the welding process and un-operability in some special cases, and endangers the safe reliability of welding structures, especially for large steel structures. In view of the fact that the industries such as petrification, high-rise buildings, bridges, and shipbuilding neither preheat the large high strength steel structure nor perform heat treatment after welding, the welding crack susceptibility index Pcm of steel is required to be as low as possible. Accordingly, a high strength steel plate having a low welding crack susceptibility has been developed in the metallurgy field.

A high strength steel having a low welding crack susceptibility, also called as CF steel, is a type of low-alloy high-strength steel of excellent welding property and low-temperature toughness, whose advantages are that preheating is not required before welding or a little preheating is required without the generation of crack, which mainly solves the welding procedure problem of large steel structures.

The way to reduce Pcm is to reduce the addition amount of carbon or alloying elements, however, to the high strength steel produced by quenching and tempering process, reducing the addition amount of carbon or alloying elements will inevitably lead to the reduction of the steel strength. The use of thermo-mechanical controlled rolling and cooling processes (TMCP) can overcome this defect. In addition, in comparison with the thermal refining process (quenching and tempering), the thermo-mechanical controlled rolling and cooling processes (TMCP) can refine the crystal grains, thus improving the low-temperature toughness of the steel.

At present, the alloying components of the steel having a low welding crack susceptibility produce by TMCP technology are typically Mn—Ni—Nb—Mo—Ti and Si—Mn—Cr—Mo—Ni—Cu—Nb—Ti—Al—B systems. For example, the chemical components of a low-alloy, high-strength steel produced by TMCP process disclosed in international publication WO99/05335 are as follows: (wt. %: percent by weight): C: 0.05-0.10 wt. %, Mn: 1.7-2.1 wt. %, Ni: 0.2-1.0 wt. %, Mo: 0.25-0.6 wt. %, Nb: 0.01-0.10 wt. %, Ti: 0.005-0.03 wt. %, P≤0.015 wt. %, S≤0.003 wt. %; for example, the chemical components of a superlow carbon bainitic steel disclosed in CN1521285 are as follows: (wt. %: percent by weight): C: 0.01-0.05 wt. %, Si: 0.05-0.5 wt. %, Mn: 1.0-2.2 wt. %, Ni: 0.0-1.0 wt. %, Mo: 0.0-0.5 wt. %, Cr: 0.0-0.7 wt. %, Cu: 0.0-1.8 wt. %, Nb: 0.015-0.070 wt. %, Ti: 0.005-0.03 wt. %, B: 0.0005-0.005 wt. %, Al: 0.015-0.07 wt. %.

The alloying elements of the above two disclosed steels are designed as Mn—Ni—Nb—Mo—Ti and Si—Mn—Cr—Mo—Ni—Cu—Nb—Ti—Al—B systems, respectively. Since Mo and Ni are both noble metals, the production costs of these types of steel plates are relatively high from the point view of the type and the total addition amount of the added alloying elements. In addition, they both use tempering heat treatment, which increases the manufacture procedures of the steel plate and enhances the production cost of the steel plate, and their Pcm values are relatively high, which has an adverse impact on welding performance.

In order to solve the above problems, the present inventors use the steel of a Si—Mn—Nb—Mo—V—Ti—Al—B system, and the present inventors design a superfine bainite battened steel plate having a low welding crack susceptibility and a yield strength of 800 MPa by use of the reinforcement effect of V, and thermo-mechanical controlled rolling and cooling processes without thermal refining, the resultant steel plate having excellent low-temperature toughness and weldability.

Contents of the Invention

The object of the present invention is to provide a steel plate having a low welding crack susceptibility and a yield strength of 800 MPa.

The other object of the present invention is to provide a manufacture method for the steel plate having a low welding crack susceptibility.

In the first aspect of the present invention, it is provided a steel plate having a low welding crack susceptibility and a yield strength of 800 MPa, which comprises the following chemical components (wt. %: percent by weight): C: 0.03-0.08 wt. %, Si: 0.05-0.70 wt. %, Mn: 1.30-2.20 wt. %, Mo: 0.10-0.30 wt. %, Nb: 0.03-0.10 wt. %, V: 0.03-0.45 wt. %, Ti: 0.002-0.040 wt. %, Al: 0.02-0.04 wt. %, B: 0.0010-0.0020 wt. %, the balance being Fe and unavoidable impurities, and the welding crack susceptibility index meets the following formula: Pcm≤0.20%.

The steel plate with a low welding crack susceptibility has a superfine bainite battened structure.

The susceptibility index Pcm to welding cracks of the steel plate with a low welding crack susceptibility can be determined according to the following formula:

$$Pcm(\%)=C+Si/30+Ni/60+(Mn+Cr+Cu)/20+Mo/15+V/10+5B.$$

The welding crack susceptibility index Pcm is an index reflecting the welding cold crack prospensity of steel. The smaller the Pcm is, the better the weldability is, while the larger the Pcm is, the worse the weldability is. Good weldability refers to a steel which uneasily generates welding crack upon welding, while poor weldability refers to a steel which easily generates crack. In order to avoid the generation of crack, preheating of the steel is required before welding, and the better the weldability is, the lower the required preheating temperature is, contrarily, the higher preheating temperature is required. According to the stipulations of the Chinese ferrous metallurgy industry standards YB/T 4137-2005, Pcm value for the steel of trademark Q800CF should be lower than 0.28%. The Pcm of the steel plate with a low welding crack susceptibility of the present invention is lower than 0.20%, which accords with the stipulations of the above standard and has an excellent welding property.

The chemical components of the steel plate with a low welding crack susceptibility and a yield strength of 800 Mpa is described in detail in the following contents.

C: Enlarging an austenitic area. C in a supersaturated ferrite structure formed in the quenching process can increase the intensity of the steel. However, C has an adverse impact on welding performance. The higher the content of C is, the poorer the welding performance is. As to a bainitic steel produced by TMCP process, the lower the content of C is, the better the toughness is, and a lower C content can produce a thicker steel plate of higher toughness, and a superfine bainitic matrix structure containing a high dislocation density can be obtained. Therefore, the content of C in the present invention is controlled at 0.03 to 0.08 wt %.

Si: Not forming carbide in the steel, but existing in the bainite, ferrite or austenite in the form of a solid solution, which can improve the intensity of the bainite, ferrite or austenite in the steel, and the solution strengthening effect of Si is stronger than that of Mn, Nb, Cr, W, Mo and V. Si can also reduce the diffusion velocity of carbon in the austenite, and makes the ferrite and pearlite C curve in the CCT curve move rightwards, thus facilitating the forming of bainite structure in the continuous cooling process. In the inventive steel, no more than 0.70 wt % of Si is added, which is favourable to improve the matching relation of intensity and toughness of the steel.

Mo: A ferritizing element, which reduces the austenitic area. Mo, solid solved in austenite and ferrite, can increase the intensity of the steel, improve the hardenability of the steel and prevent temper brittleness. Since the present invention does not need the treatment of thermal refining, only no more than 0.30 wt % of Mo, which is a very expensive element, is added to achieve the purpose of reducing the cost.

Nb: In the present invention, a relatively high amount of Nb is added in order to realize two purposes, in which one purpose is to refine crystal grains and increase the thickness of the steel plate, and the other purpose is to enhance the non-recrystallization temperature of the steel and facilitates the use of relatively high finish rolling temperature in the rolling process, thus accelerating the rolling speed and increasing the production efficiency. In addition, since Nb strengthens the grain refining effect, thicker steel plate can be produced. In the present invention, 0.03-0.10 wt. % of Nb is added to give consideration to the solution strengthening effect and the fine grain strengthening effect of Nb.

V: A ferritic formation element, which reduces austenitic area significantly. V dissolved in an austenite at a high temperature can improve the hardenability of the steel. The carbide of V, i.e. $V_4C_3$ in the steel is relatively stable, and can inhibit the movement of the grain boundary and the growth of the crystal grains. V can refine the as cast structure of welding metal, reduce the overheating sensitivity of the heat affected zone, and prevent the excessive growth and coarsening of the grains near the fusion line in the heat affected zone, which is favorable to the welding performance. In the present invention, 0.03-0.45 wt. % of V is added to improve the intensity of the steel greatly. V and Cu can both play a role of precipitation strengthening in the steel, however, in comparison with Cu, only a minute quantity of V is added to achieve the same precipitation strengthening effect. In addition, since Cu tends to induce the grain boundary cracks in the steel, Ni, which also a very expensive alloy element, the adding amount of which is at least half of the amount of Cu, must be added to avoid the cracks. Therefore, replacing Cu with V can greatly reduce the manufacturing cost of the steel.

Ti: A ferritic formation element, which reduces austenitic area significantly. The carbide of Ti, i.e. TiC, is relatively stable, and can inhibit the growth of the crystal grain. Ti, solid solved in austenite, is favourable to improve the hardenability of the steel. Ti can reduce the first type of the temper brittleness, i.e. 250-400° C. temper brittleness. Since the present invention does not need the thermal refining, the adding amount of Ti can be reduced. In the present invention, 0.002-0.040 wt. % of Ti is added, which forms fine carbonitride to precipitate out, thus refining the Bainite battened structure.

Al: Al can increase the driving force of the phase change from austenite to ferrite and can intensively reduce the phase cycle of the austenite. Al interacts with N in the steel to form fine and diffusive AlN, which precipitates out and can inhibit the growth of the crystal grain, thus achieving the purpose of refining crystal grains and improving the low temperature toughness of the steel. Too high content of Al will have an adverse impact on the hardenability and welding performance of the steel. In the present invention, no more than 0.04 wt. % of Al is added to refine crystal grains, improve the toughness of the steel and guarantees the welding performance.

B: B can dramatically increase the hardenability of the steel. In the present invention, 0.001-0.002wt. % of B is added so that one can readily obtain a high intensity bainite structure from steel under a certain cooling conditions.

In a second aspect of the present invention, it is provided a manufacturing method of a steel plate having a low welding crack susceptibility and a yield strength of 800 MPa, which comprises smelting, casting, heating, rolling and cooling procedures, wherein after rolling procedure, the steel is subjected to the cooling procedure without the thermal refining.

In a preferred embodiment, the thickness of the casted continuous casting billet or steel ingot is not less than 4 times of the thickness of the finished steel plate.

In another preferred embodiment, the heating temperature in the heating process is 1050 to 1180° C., and the holding time is 120 to 180 minutes.

In another preferred embodiment, the rolling is divided into the first stage of rolling and the second stage of rolling.

In another preferred embodiment, in the first stage of rolling, the start rolling temperature is 1050 to 1150° C., and when the thickness of the rolled piece reaches twice to three times of that of the finished steel plate, the rolled piece stays on the roller bed until the temperature reaches 800-860° C.

In another preferred embodiment, the Pass deformation rate in the second stage of rolling is 10-28%, and the finish rolling temperature is 780-840° C.

In another preferred embodiment, in the cooling process, the steel plate enters an accelerated cooling device and is cooled at a rate of 15 to 30° C./S to a temperature of 350 to 400° C., followed by air cooling.

In another preferred embodiment, the air cooling is performed by the way of cooling in packed formation or bank cooling.

In the manufacturing method of a steel plate having a low welding crack susceptibility and a yield strength of 800 MPa, the technical control mechanism of the main steps is analyzed as follows:

1. Rolling Process

When the thickness of the rolled piece reaches twice to four times of that of the finished steel plate, the rolled piece stays on the roller bed until the temperature reaches 800 to 860° C. For the steel containing Nb, the non-recrystallizing temperature is about 950 to 1050° C., and it is firstly rolled at a relatively high temperature from 1050 to 1150° C. to produce a certain dislocation density in the austenite, then during the relaxation process of lowering the temperature to roll the billet to 800-860° C., the inside of the austenite crystal grains is subjected to a restoration and statically recrystallization process, thus refining the austenite crystal grains. In the relaxation process, individual precipitation and complex precipitation of carbonitride of Nb, V and Ti occur. The precipitated carbonitride pins the dislocation and subgrain boundary movement, reserves a lot of dislocation in the austenite crystal grains, and provides a lot of nucleation sites for the formation of bainite during the cooling process. Rolling at 800-860° C. greatly increases the dislocation density in the austenite, and the carbonitride precipitated at the dislocation inhibits the coursing of the deformed crystal grains. Due to the precipitating effect caused by deformation, a relatively large Pass deformation will facilitate the formation of finer and more diffusive educts. High dislocation density and fine and diffusive educts provide high density of nucleation sites for bainite, and the pining effect of the second phase particles to the bainite growth interface inhibits the growth and coursing of the bainite battern, which is beneficial for both the intensity and toughness of the steel.

The finish rolling temperature is controlled in the low temperature section of the non-recrystallization zone, and at the same time, this temperature section is close to the transmission point $Ar_3$, i.e. the finish rolling temperature is 780-840° C., and finishing rolling within this temperature range can increase the defects in the austenite by increasing the deformation and inhibiting the restoration, thus providing higher energy accumulation for the bainite phase change while not bringing about too much burden to the roller, suitable for producing thick plate.

2. Cooling Process

After the rolling is complete, the steel plate enters an accelerated cooling device, and cooled to 450 to 500° C. at a cooling rate of 15 to 30° C./s. Rapid cooling speed can avoid the formation of ferrite and pearlite, and the steel plate directly enters the bainite transition area of the CCT curve. The phase change driving force of the bainite can be represented by $$\Delta G=\Delta G_{chem}+\Delta G_d$$

wherein $\Delta G_{chem}$ is a chemical driving force, $\Delta G_d$ is a strain stored energy caused by defects. Since rapid cooling speed causes the overcooling of the austenite and increases the driving force of a chemical phase change, $\Delta G_{chem}$ should be considered in combination with the strain stored energy $\Delta G_d$ caused in the rolling process to increase the driving force of the bainite nucleation. Due to the high dislocation density in the crystal grains, the nucleation sites of bainite increase. Considered by combining the thermodynamic and dynamic factors, the bainite can nucleate at a very large speed. Rapid cooling speed enables the bainite transformation to be completed quickly and inhibits the coarsing of the bainite ferrite battern. After exiting from the accelerated cooling device, the steel is cooled in packed formation at 450-550° C. or air cooled in a cold bed to make the carbide of V in the ferrite precipitate more completely, thus enhancing the contribution of the precipitation strengthening to the intensity.

The steel for high intensity mechanical equipment and engineering construction needs high intensity and excellent toughness. A variety of factors will contribute to the intensity, which can be represented by the following formula:

$$\sigma=\sigma_f+\sigma_p+\sigma_{sl}+\sigma_d$$

wherein $\sigma_f$ is fine grain strengthening, $\sigma_p$ is precipitation strengthening, $\sigma_{sl}$ is solid solution strengthening, and $\sigma_d$ is dislocation strengthening. Thermo-mechanical treatment of the steel plate is usually done by Thermo-mechanical Controlled Rolling and Controlled Cooling Process (TMCP), which refines the microstructures or forms the high intensity structures such as ultra-fine bainite by controlling-deformation rate and cooling rate, thus improving the yield strength of the steel. Modified TMCP and Relaxation Precipitation Controlling (RPC) technology form a stable dislocation network, diffusive and fine second phase particles precipitate out at the dislocation and subgrain boundary, the bainite battern is refined by promoting the nucleation and inhibiting its growth, and a combined action of dislocation strengthening, precipitation strengthening and fine grain strengthening is produced, thus improving the intensity and roughness of the steel. Its principle mechanism is as follows:

The steel plate fully deforms in the recrystallization zone and the deformed austenite produces a high defect accumulation, thus greatly increasing the dislocation density in the austenite. Restoration and recrystallization occurring during the rolling refine the original austenite crystal grains. After being rolled and deformed, dislocation within the crystals will re-arrange during the controlled cooling relaxation. Since a hydrostatic pressure field exits in the edge dislocation, interstitial atom such as B will enrich to the dislocation, grain boundary and subgrain boundary, reduce the dislocation mobility, and finally the high density dislocation caused by the deformation will evolve during the restoration to form a stable dislocation network. During the relaxation, the microalloy elements such as Nb, V, Ti and the like precipitate out at the grain boundary, subgrain boundary and dislocations in the form of carbonitride of different stoichiometric ratios such as $(Nb,V,Ti)_x(C,N)_y$ and the like. The second phase particles, such as the precipitated carbonitrides, pin the dislocations and subgrain boundary within the crystal grains and stabilize the substructures such as dislocation wall.

Following relaxation, the dislocation density of austenite is increased by the second stage of rolling process. After relaxation, when the deformed austenite is accelerated cooled, the effects of the austenite with dislocation and precipitation formed by relaxation process on the following phase transformation can be interpreted as (different from the circumstance that after deformation, no relaxation occurs and a lot of dislocations disorderly distribute): firstly, a subgrain boundary which has a certain orientation difference is a preferred position for the nucleation, and if a second phase, which has an incoherent interface with the matrix, precipitates out, it will facilitate the new phase nucleation, and, after relaxation, a lot of new phase crystal grain will nucleate within the original austenite crystal grains. Secondly, since after relaxation, a certain amount of dislocations move to the subgrain boundary, which increases the orientation difference between the subgrains to a cartain extent. After the mediate temperature transformed product, such as bainite, nucleates at the subgrain boundary, it is hindered by the forward subgrain boundary during the growth. When the bainite ferrite forms, its phase change interface is daggled by the precipitated second phase carbonitride particles, which inhibits its growth. TMCP plus RPC process forms a high density of dislocation network structure, and the second phase precipitation material points provide a lot of potential nucleation sites for the nucleation of the bainite ferrite, and, the daggling effect of the second phase particles to the moving interface and the evolved subgrain boundary inhibits the growth of the bainite.

Therefore, the manufacturing process of the present invention can play a combined role of promoting the nucleation of the bainite and inhibiting the growth of the bainite, thus refining the final structure.

THE BEST EMBODIMENT OF THE PRESENT INVENTION

Figure 1A:
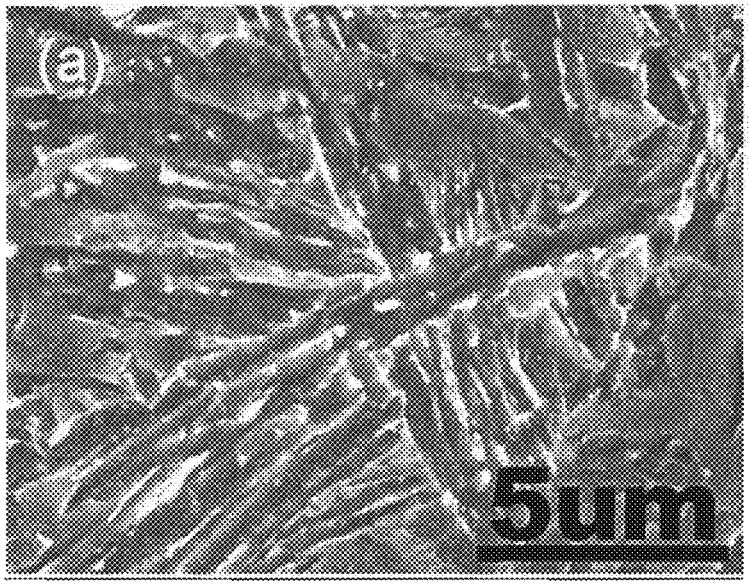
FIG. 1*a* is a scanning electron microscope (SEM) micrograph showing the microstructure of the steel plate having a low welding crack susceptibility of the present Example 5.

The invention is further illustrated by the following examples in combination with the figures. These examples are only intended to illustrate the best embodiment of the invention, but not to limit the scope of the invention.

Example 1

The chemical components as shown in Table 1 were smelt in an electric furnace or a converter and casted to a continuous casting billet or steel ingot, which was then heated to 1100° C. for 120 min and was subjected to the first stage of rolling in a middle, thick rolling mill, wherein the start rolling temperature in the first stage of rolling was 1050° C.; and, when the thickness of the rolled piece was 60 mm, it stayed in the roller bed until the temperature reached 850° C., and then the second stage of rolling was performed, wherein the Pass deformation rate in the second stage of rolling was 15-28%, the finish rolling temperature was 830° C., and the thickness of the finished steel plate was 20 mm. After the rolling was complete, the steel plate was delivered into an accelerated cooling (ACC) device, and cooled to 500° C. at a cooling rate of 30° C./s, followed by cooling in packed formation or in a cold bed.

Example 2

It was performed as Example 1 with the exception that the heating was performed at 1050° C. for 240 min, wherein the start rolling temperature in the first stage of rolling was 1040° C., and the thickness of the rolled piece was 90 mm; the start rolling temperature in the second stage of rolling was 840° C., the Pass deformation rate was 15-20%, the finish rolling temperature was 810° C., and the thickness of the finished steel plate was 30 mm; and, the cooling rate of the steel plate was 25° C./S, and the final temperature was 490° C.

Example 3

It was performed as Example 1 with the exception that the heating was performed at 1150° C. for 150 mins, wherein the start rolling temperature in the first stage of rolling was 1080° C., and the thickness of the rolled piece was 120 mm; the start rolling temperature in the second stage of rolling was 830° C., the Pass deformation rate was 10-15%, the finish rolling temperature was 820° C., and the thickness of the finished steel plate was 40 mm; and, the cooling rate of the steel plate was 20° C./S, and the final temperature was 530° C.

Example 4

It was performed as Example 1 with the exception that the heating was performed at 1120° C. for 180 min, wherein the start rolling temperature in the first stage of rolling was 1070° C., and the thickness of the rolled piece was 150 mm; the start rolling temperature in the second stage of rolling was 830° C., the Pass deformation rate was 10-20%, the finish rolling temperature was 800° C., and the thickness of the finished steel plate was 50 mm; and, the cooling rate of the steel plate was 15° C./S, and the final temperature was 515° C.

Example 5

It was performed as Example 1 with the exception that the heating was performed at 1130° C. for 180 min, wherein the start rolling temperature in the first stage of rolling was 1080° C., and the thickness of the rolled piece was 150 mm; the start rolling temperature in the second stage of rolling was 840° C., the Pass deformation rate was 10-15%, the finish rolling temperature was 810° C., and the thickness of the finished steel plate was 60 mm; and, the cooling rate of the steel plate was 15° C./S, and the final temperature was 480° C.

Example 6

It was performed as Example 1 with the exception that the heating was performed at 1120° C. for 180 mins, wherein the start rolling temperature in the first stage of rolling was 1050° C., and the thickness of the rolled piece was 120 mm; the start rolling temperature in the second stage of rolling was 820° C., the Pass deformation rate was 15-25%, the finish rolling temperature was 780° C., and the thickness of the finished steel plate was 40 mm; and, the cooling rate of the steel plate was 20° C./S, and the final temperature was 540° C.

TABLE 1

The chemical components (wt. %: percent by weight) and Pcm (%) of the steel plate with a low welding crack susceptibility of Examples 1-6 of the present invention

| Example | C wt. % | Si wt. % | Mn wt. % | Nb wt. % | V wt. % | Al wt. % | Ti wt. % | Mo wt. % | B wt. % | Fe and unavoidable impurities wt. % | Pcm % |
|---|---|---|---|---|---|---|---|---|---|---|---|
| 1 | 0.04 | 0.35 | 1.80 | 0.070 | 0.055 | 0.02 | 0.015 | 0.30 | 0.0018 | balance | 0.176 |
| 2 | 0.03 | 0.60 | 1.50 | 0.045 | 0.45 | 0.03 | 0.02 | 0.22 | 0.001 | balance | 0.189 |
| 3 | 0.04 | 0.40 | 2.2 | 0.035 | 0.10 | 0.04 | 0.012 | 0.10 | 0.0011 | balance | 0.186 |
| 4 | 0.05 | 0.55 | 1.50 | 0.040 | 0.15 | 0.03 | 0.01 | 0.25 | 0.0015 | balance | 0.183 |
| 5 | 0.06 | 0.05 | 1.45 | 0.065 | 0.30 | 0.03 | 0.02 | 0.20 | 0.0010 | balance | 0.183 |
| 6 | 0.06 | 0.15 | 1.30 | 0.047 | 0.03 | 0.02 | 0.03 | 0.25 | 0.0020 | balance | 0.180 |

Test Example 1

The steel plates with a low welding crack susceptibility of Examples 1-6 of the present invention were tested for their mechanical property and the results were shown in Table 2.

TABLE 2

The mechanical property of the steel plates with a low welding crack susceptibility of Examples 1-6 of the present invention

| Example | Yield strength (MPa) | Tensile strength (MPa) | elongation (%) | −20° C. Akv (longitudinal) (J) |
|---|---|---|---|---|
| 1 | 840, 865 | 950, 965 | 17.0, 16.5 | 221, 216, 224 |
| 2 | 850, 875 | 960, 970 | 15.9, 17.2 | 218, 210, 209 |
| 3 | 855, 860 | 958, 965 | 16.0, 16.0 | 215, 222, 222 |
| 4 | 845, 840 | 954, 950 | 16.1, 16.3 | 211, 208, 206 |
| 5 | 858, 875 | 969, 973 | 17.0, 17.5 | 227, 231, 224 |
| 6 | 859, 863 | 967, 982 | 17.3, 17.3 | 215, 211, 219 |

From Tables 1 and 2, it could be seen that Pcm of the steel plate with a low welding crack susceptibility of the present invention was ≤0.20%, the yield strength was larger than 800 MPa, the tensile strength was larger than 900 MPa, and the Charpy impact energy Akv (−20° C.) was ≥150 J, and the thickness of the plate was up to 60 mm, and the steel plate had excellent low-temperature toughness and weldability.

Test Example 2

The steel plate with a low welding crack susceptibility of Example 1 of the present invention was tested for its weldability (small Tekken test). Under ambient temperature and 50° C., no crack was observed (See Table 3), indicating that the steel plate of the present invention had excellent welding property and typically no preheating was needed when welding.

TABLE 3

The test results of the weldability of the steel plate with a low welding crack susceptibility of Example 1 of the present invention

| Test temperature | Sample No. | Surface crack percentage, % | Root crack percentage, % | Cross-section crack percentage, % | Ambient temperature | Relative humidity |
|---|---|---|---|---|---|---|
| RT | 1 | 0 | 0 | 0 | 25° C. | 65% |
| | 2 | 0 | 0 | 0 | | |
| | 3 | 0 | 0 | 0 | | |
| 50° C. | 4 | 0 | 0 | 0 | | |
| | 5 | 0 | 0 | 0 | | |

Test Example 3

Figure 1B:
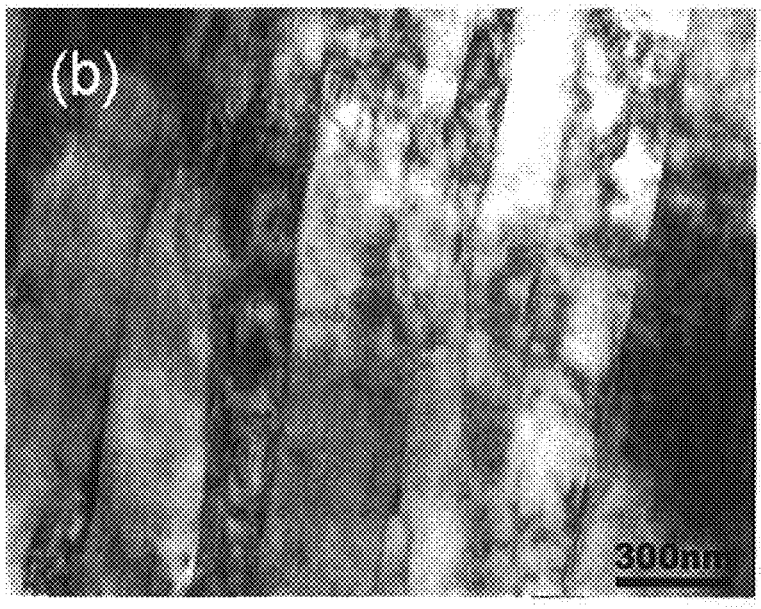
FIG. 1*b* is a transmission electron microscope (TEM) micrograph showing the microstructure of the steel plate having a low welding crack susceptibility of the present Example 5.

The steel plate with a low welding crack susceptibility of Example 5 of the present invention was studied for its microscopic structure, and its scanning electron microscope (SEM) micrograph and transmission electron microscope (TEM) micrograph are shown in FIG. 1*a* and FIG. 1*b*, respectively.

From FIG. 1*a*, it could be seen that the bainite batten was thinned, and carbide precipitated out on the edge of the bainite batten, and fine carbide also precipitated out on the bainite batten. From FIG. 1*b*, it could be seen that the bainite batten was comprised of fine nano-scale bainite batten.

In summary, the steel plate of the present invention has fine banite batten structure and ultrafine nano-scale banite batten sub-structure. The ultrafine banite batten structure provides fine grain strengthening effect, the second phase particles precipitating out along the grain boundary of the ultrafine banite batten provide precipitation strengthening effect, and the dislocation structure within the ultrafine banite batten provides dislocation strengthening effect, and, the combined action of these strengthening effects guarantees the strength and toughness of the steel plate of the present invention.

INDUSTRIAL APPLICABILITY

The beneficial effects of the present invention are as follows:

1. The chemical components are reasonably designed by greatly reducing the content of C, partly replacing Mo with cheap alloy elements such as Mn, replacing the precipitation strengthening effect of Cu with the precipitation strengthening effect of fine precipitated particles of carbonitride of V, and adding no noble elements such as Ni. As a consequence, the content of the alloy element is low, the cost of the starting materials is low, the welding crack susceptibility is low and no preheating is needed before welding.

2. Since the steel plate of the present invention does not need any additional thermal refining treatment, the manufacturing procedure is simplified and the manufacture cost of the steel is reduced.

3. Due to the reasonable components and process design, from the point of view of the implementing effects, the process conditions are relatively relaxed and the steel plate can be produced stably in a middle, thick steel plate production line.

4. The yield strength of the steel plate with a low welding crack susceptibility of the present invention is larger than 800 MPa, the tensile strength is larger than 900 MPa, and the Charpy impact energy Akv (−20° C.) is ≥150 J; and, the thickness of the plate is up to 60 mm, the welding crack susceptibility index Pcm is ≤0.20%, and the steel plate has excellent low-temperature toughness and weldability.

The invention claimed is:

1. A steel plate, wherein the composition of said steel plate consisting of (wt. %: percent by weight):

C: 0.04-0.08,
Si: 0.05-0.70,
Mn: 1.30-2.20,
Mo: 0.10-0.25,
Nb: 0.03-0.10,
V: 0.03-0.45,
Ti: 0.002-0.040,
Al: 0.02-0.04,
B: 0.0010-0.0020,
Fe: Balance,
and unavoidable impurities, said steel plate has a bainite battened structure,
said steel plate having a yield strength of 800-875 MPa, and
said steel plate having a welding crack susceptibility index of $P_{cm} \leq 0.20\%$.

* * * * *